United States Patent [19]

Ohno et al.

[11] 4,211,243

[45] Jul. 8, 1980

[54] PROCESS FOR PRODUCING EXPANDED TOBACCO STEMS

[75] Inventors: Masayuki Ohno, Hiratsuka; Kazuhiko Akutagawa, Hadano; Hiroo Inui, Tokyo; Yoshihiko Nishizawa; Naoshi Tsukada, both of Noda; Takeshi Akao, Abiko, all of Japan

[73] Assignees: Kikkoman Shoyu Co., Ltd., Noda; The Japan Tobacco & Salt Public Corporation, Tokyo, both of Japan

[21] Appl. No.: 880,008

[22] Filed: Feb. 21, 1978

[30] Foreign Application Priority Data

Feb. 22, 1977 [JP] Japan ..... 52-17709

[51] Int. Cl.[2] ..... A24B 3/18

[52] U.S. Cl. ..... 131/140 P

[58] Field of Search ..... 131/140 P, 126, 133 A, 131/140 R, 140 A; 426/621, 445, 447, 448, 449, 450, 625

[56] References Cited

U.S. PATENT DOCUMENTS

| | | | |
|---|---|---|---|
| 1,789,435 | 1/1931 | Hawkins | 131/140 P X |
| 2,344,106 | 3/1944 | Reed | 131/136 |
| 2,596,183 | 5/1952 | Sowa | 131/140 P |
| 2,653,093 | 9/1953 | Baer | 131/140 P UX |
| 3,409,027 | 11/1968 | de la Burde | 131/140 P |
| 3,409,028 | 11/1968 | de la Burde | 131/140 P |
| 3,524,452 | 8/1970 | Moser | 131/140 P |
| 3,529,606 | 9/1970 | de la Burde | 131/140 P |
| 3,557,798 | 1/1971 | Ashworth | 131/140 P |
| 3,734,104 | 5/1973 | Buch | 131/140 P |

FOREIGN PATENT DOCUMENTS

| | | | |
|---|---|---|---|
| 675292 | 7/1952 | United Kingdom | 131/140 P |

*Primary Examiner*—V. Millin

*Attorney, Agent, or Firm*—Schuyler, Birch, McKie & Beckett

[57] ABSTRACT

Expanded porous tobacco stems with a low apparent density and an excellent quality of smoking taste are obtained by heating under a pressurized atmosphere tobacco stems separated from tobacco leaves, as such or after moisturization, at a temperature of 150° to 300° C. and a pressure of 3 kg/cm$^2$ (gage) or more in the presence of superheated steam for a period of 30 seconds or less and suddenly releasing the pressure to effect expansion of the stems. The resulting expanded stems are shredded into cut tobacco stems or made into reconstituted tobacco sheet to provide a tobacco material of excellent filling capacity.

4 Claims, No Drawings

PROCESS FOR PRODUCING EXPANDED TOBACCO STEMS

This invention relates to a process for producing expanded tobacco stems (the term "stems" as used herein includes stems and veins of tobacco leaves).

As compared with other parts of leaf blades, stems which occupy nearly 20 to 30% (W/W) of the tobacco leaves are poorer in alkaloids and other nitrogen compounds, ether extracts, saccharides, and the like, while richer in cell membrane substances such as cellulose, pentosans, etc., and generate a smoke having sharp irritating odor and taste. Accordingly, with respect to smoking taste, stems are quite inferior as the tobacco material to other parts of the tobacco leaves.

A part or whole of the stems has heretofore been processed for use as a tobacco material by rolling and shredding into cut stems or by heating and grinding to a fine powder which is mixed with other tobacco fines binders, etc. and shaped into a sheet form. The cut stems or tobacco sheets thus obtained, however, are hardly expected to improve the filling capacity of other tobacco materials because of their high apparent density and are also not satisfactory with respect to smoking taste.

As a means to transform tobacco leaves or tobacco stems into tobacco products, various procedures have been known for expanding or puffing these materials. Of the known procedures, examples of those which use heating or moisturization but not pressure difference in effecting the expanding include a puffing procedure in which tobacco leaves or stems are impregnated with a volatile organic liquid and then contacted with a hot gas stream at a temperature of 30° F. or higher (U.S. Pat. No. 3,524,452); a puffing process which utilizes such heating equipments as "heat gun" and "jetzone particle oven" to heat tobacco stems in fluidized suspension at 200° to 500° C. for a short period of time under atmospheric pressure (U.S. Pat. No. 3,529,606); another expanding procedure in which tobacco stems are moistened to a moisture content of 24 to 60% and heated by the contact with a hot gas at 250° to 750° F. for a short period of time in a heating equipment such as "dispersion dryer" (U.S. Pat. No. 3,734,104); and a procedure in which expansion is effected by adding water to shredded tobacco and thereafter bringing the moisture content to the initial value (U.S. Pat. No. 2,596,183).

Examples of other known procedures which utilize a pressure difference in effecting the puffing include a procedure in which cured and moistened tobacco leaves are heated in a live steam, for example, at 110° C. and 20 psi (1.4 kg/cm$^2$) for about 45 minutes and the pressure is then reduced to atmospheric pressure (U.S. Pat. No. 1,789,435); a procedure in which by using a special puffing equipment provided with an internal conveyor tobacco stems are heated under a gas atmosphere of a relatively high pressure and thereafter the pressure is released to effect expansion (U.S. Pat. No. 2,344,106); a procedure in which green tobacco leaves are kept under a reduced pressure of 1 inHg (abs.) or less and thereafter the pressure is brought to atmospheric pressure by feeding heated steam (U.S. Pat. No. 3,557,798); and a process involving the step of puffing tobacco stems by heating by means of a known technique such as microwave heating, and either the step of adding water to the puffed stems followed by evaporation of the water (U.S. Pat. No. 3,409,028), or the step of spreading said puffed stems (U.S. Pat. No. 3,409,027).

According to the above-mentioned known procedures, there has never been provided a tobacco material which is satisfactory in smoking taste, though a certain degree of improvement in the filling capacity can be achieved.

In order to alleviate above difficulties, the present inventors carried out an extensive investigation on the process for treating the tobacco stems and, as a result, have found that the expanded tobacco stems obtained by treating the stems under specified temperature, pressure and other conditions and then bringing the pressure to a lower level have an excellent smoking taste and are porous, the apparent density being low. It was also found possible to obtain a tobacco material excellent in smoking taste as well as in filling capacity by processing the expanded stems into cut tobacco stems or reconstituted tobacco sheets.

An object of this invention is to provide expanded porous tobacco stems having an excellent smoking taste and a low apparent density and a process for producing same.

Another object of this invention is to provide a tobacco material suitable for manufacturing cut tobacco stems or porous reconstituted sheet tobacco excellent in filling capacity and in smoking taste.

Other objects and advantages of this invention will become apparent from the following description.

According to the process of this invention, expanded tobacco stems are obtained by heating under pressure tobacco stems separated from tobacco leaves as such or after moisturization at a pressure of 3 kg/cm$^2$ (gage) or higher and at a temperature of 150° to 300° C. in the presence of superheated steam for a period of 30 seconds or less and suddenly bringing the pressure to a lower level to effect expanding.

The expanded tobacco stems produced according to this invention have advantages in that (1) since the apparent density of the stems is markedly reduced, the cut stems or tobacco sheets obtained from the expanded tobacco stems are improved in filling capacity, (2) when the pressure is brought to a lower level from a higher level, the volatile basic constituents such as alkaloids, ammonia and amines which are viceous constituents contained in the tobacco stems are released from the stems, resulting in soft and desirable smoking taste of the expanded stems, and (3) operation in the rolling and grinding steps which are indispensable in manufacturing cut stems or reconstituted tobacco sheets becomes very easy.

In carrying out the process of this invention, at first the stems separated from tobacco leaves by threshing in a customary way are shredded to a suitable dimension and the shredded stems are expanded either as such or after pre-conditioned by adding water to a water content of 7 to 22% (W/W), preferably 10 to 18% (W/W). It is to be noted here that if the water content of the stems exceeds 23% or is below 7%, not only the expanding degree is decreased but also the quality of smoking taste is degraded. The expanding treatment is carried out by placing the stems in a vessel for expanding treatment and heating the stems under pressure in the presence of superheated steam at a pressure of 3 to 10 kg/cm$^2$ (gage), preferably 4 to 8 kg/cm$^2$ (gage), and at a temperature of 150° to 300° C., preferably 190° to 260° C., for 1 to 30 seconds, preferably 2 to 15 seconds.

Thereafter, the pressure in the expanding vessel is suddenly released or the contents of the vessel are discharged into an atmosphere at lower pressures or into the atmospheric air to produce the expanded tobacco stems.

The vessel for use in the expanding treatment may be of any dimension or of any construction regardless of the type whether continuous or batch, so long as it withstands the applied pressure. An example of particularly suitable type is an apparatus for producing expanded food stuffs by gaseous conveying heating (hereinafter referred to as "an apparatus for heating in pressurized gas stream") described in U.S. Pat. No. 3,661,071 (Japanese Patent Publication No. 34,747/71).

The conditions for the expanding treatment of tobacco stems according to this invention were determined by the experiments described below.

The tobacco stems separated from flue-cured tobacco leaves by threshing were passed through an ordinary crusher to cut the stems to a length of 10 to 50 mm [water content, 11.0% (W/W)]. The cut stems together with superheated steam were fed to an apparatus for heating in pressurized gas stream described in U.S. Pat. No. 3,661,071 (Japanese Patent Publication No. 34,747/71) and heated at 220° C. for 6 seconds under various pressures ranging from 0 to 8 kg/cm$^2$ (gage) as shown in Table 1. The heated stems are then discharged into the atmospheric air to obtain the expanded tobacco stems. In Table 1 are shown the results of analysis and evaluation of smoking taste of the samples. The total amount of volatile basic substances given in the table was determined by the method of J. A. Bradford et al. described in Industrial and Engineering Chemistry, Vol. 29, 45–50 (1937).

The evaluation of smoking taste was performed by an organoleptic testing panel of 20 members by comparing with a control sample (without pressure treatment) on three test items of undesirable odor, mildness, and total evaluation. The results of evaluation were expressed in mean values of evaluation marks, 0 to 3 for each test item, given by the twenty members.

Evaluation mark:

0: comparable to the control

+1: slightly better than the control

+2: better than the control

+3: remarkably better than the control

Table 1

| Pressure, kg/cm$^2$ (gage) | 0 | 1 | 2 | 3 | 4 | 5 | 6 | 7 | 8 |
|---|---|---|---|---|---|---|---|---|---|
| Apparent density, g/cm$^3$ | 0.89 | 0.77 | 0.74 | 0.47 | 0.26 | 0.25 | 0.23 | 0.21 | 0.21 |
| Total volatile bases, % | 0.23 | 0.22 | 0.21 | 0.17 | 0.15 | 0.13 | 0.13 | 0.12 | 0.10 |
| pH | 5.16 | 5.15 | 5.15 | 5.10 | 5.09 | 5.07 | 5.06 | 5.05 | 5.02 |
| Smoking taste: | | | | | | | | | |
| Undesirable odor | — | 0 | +0.8 | +2.2 | +2.6 | +2.8 | +2.8 | +2.9 | +2.8 |
| Mildness | — | 0 | 0 | +1.6 | +2.0 | +2.2 | +2.4 | +2.5 | +2.6 |
| Total evaluation | — | 0 | 0 | +2.2 | +2.6 | +2.8 | +2.8 | +2.8 | +2.7 |

It is seen from the results shown in Table 1 that when the pressure during heating period is 3 kg/cm$^2$ (gage) or higher, particularly 4 kg/cm$^2$ or higher, the apparent density, total volatile bases, pH and smoking taste are all excellent. If the pressure is below 2 kg/cm$^2$, substantially no difference is perceptible between the expanded stems and the control in all of the apparent density, total volatile bases and smoking taste.

In treating the stems by the process of this invention, if the treating temperature exceeds 300° C., the expanded stems will acquire a smell of scorching and a dark color, while if the temperature is below 150° C., the original smell of the unexpanded stems will remain unchanged and so the smoking taste will not be sufficiently improved. A treating pressure of higher than about 10 kg/cm$^2$ (gage) will result in disadvantages of increased investment in the apparatus for expanding treatment and increased running cost. A treating time greater than 30 seconds is also disadvantageous, because the smoking taste will be of scorching.

The expanded stems produced according to this invention are converted into a tobacco material either by a procedure in which the expanded stems are rolled to a thickness of 1 to 2 mm and shredded to a width of 0.1 to 0.2 mm to obtain cut stems or by a procedure in which the expanded stems are ground to a fine powder passing through a 0.1–0.8 mm-mesh screen, then admixed with powdered tobacco leaves and stems and a binder, the resulting admixture is shaped into sheet form, and the sheet is shredded to obtain cut tobacco. By either of the above procedures, there is obtained a cut material having a higher filling capacity than that of conventional cut tobacco stems or cut tobacco sheet.

Forming the sheet of reconstituted tobacco can be performed by grinding the expanded tobacco stems, dispersing the ground stems in an aqueous solution of a binder (cellulose derivatives, natural gums, etc.) and a humectant, casting the resulting slurry on a stainless steel endless belt, and drying the cast sheet (slurry process); by adding water to nearly the same weight of a mixture of expanded tobacco stems in powder form and a gum to a water content of about 55%, kneading the resulting mixture on a roll mill, and extruding the kneaded mixture through the last pair of kneading rolls into a sheet form (extrusion process); or by laminating the ground expanded tobacco stems on both sides of a cellulose material of high $\alpha$-cellulose content, drying and conditioning the cellulose material, and rolling the material by means of a hot roll mill into sheet form (saturation process).

The sheet tobacco obtained by blending with the expanded stems produced according to this invention has a markedly improved smoking taste and also a markedly reduced apparent density.

The invention is illustrated below in further detail with reference to Examples, but the invention is not limited thereto.

EXAMPLE 1

The tobacco stems separated by threshing are passed through a cutter mill to crush the stems to a length of 5 to 20 mm. The resulting stem pieces [11% (W/W) water content] thus obtained were continuously fed together with superheated steam at 6 kg/cm$^2$ (gage) into an apparatus for heating in pressurized gas stream, described in U.S. Pat. No. 3,661,071 (Japanese Patent Publication No. 34,747/71), at a rate of 100 kg/hour. After having been heated under steam pressure in the apparatus at 210° C. for 5 seconds, the stems were discharged into the atmospheric air to obtain 96 kg/hour of expanded tobacco stems (0.23 g/cm$^3$ apparent density) which are excellent in smoking taste.

EXAMPLE 2

The stems separated from flue-cured tobacco leaves produced in China were shredded to a length of 10 to 40 mm and moisturized to a water content of 15% (W/W). 20 Kilograms of the moisturized stems were charged into a 100-liter expanding treatment vessel of the batch type. Superheated steam at 5 kg/cm$^2$ (gage) and 240° C. was fed to the vessel. After about 15 seconds, the top cover of the vessel was suddenly removed to obtain 18.2 kg of expanded tobacco stems (apparent density 0.24 g/cm$^3$) of desirable smoking taste.

Application Example 1

The expanded tobacco stems obtained in Example 1 were warmed and then rolled by passing through 1.2 mm nip of a pair of rolls. The rolled stems were shredded to a width of 0.15 mm by means of a shredding machine to obtain cut stems (apparent density 0.40 g/cm$^3$) of a desirable smoking taste.

Application Example 2

35 Kilograms of the expanded tobacco stems, which had been obtained in Example 1 and ground to a powder, were mixed with 55 kg of finely powdered tobacco leaves. To the mixture was added 2 kg of an aqueous solution containing 3 kg of carboxymethylcellulose sodium, 2 kg of sorbitol, 3 kg of propylene glycol and 2 kg of glyoxal, and thoroughly mixed. A tobacco material in tacky sheet form was prepared from the mixture and rolled to a thickness of 0.1 mm to obtain 108 kg of sheet tobacco (apparent density 0.64 g/cm$^3$) having an excellent smoking taste.

Application Example 3

20 Kilograms of the expanded tobacco stems, which had been obtained in Example 2 and ground to a powder, were added to 80 kg of powdered tobacco leaves. To the resulting blend, were added 20 kg of carboxymethylcellulose, 10 kg of propylene glycol, 2 kg of glyoxal and 500 kg of water. After thorough mixing, the resulting uniform, viscous slurry was extruded on a stainless-steel endless belt to form a coating of 0.1 mm thickness. After drying, the coating film was peeled off from the belt to obtain 148 kg of sheet tobacco (apparent density 0.59 g/cm$^3$).

What is claimed is:

1. A process for producing expanded tobacco stems, which comprises heating under a pressurized atmosphere in the presence of superheated steam tobacco stems separated from tobacco leaves at a temperature of 190° to 260° C. and a pressure of 3 to 10 kg/cm$^2$ (gage) for 1 to 30 seconds and suddenly bringing the pressure to atmospheric pressure to effect expansion of the stems.

2. A process according to claim 1, wherein the moisture content of the tobacco stems is 7 to 22% (W/W).

3. A process according to claim 1, wherein the pressure is 4 to 8 kg/cm$^2$ (gage).

4. A process according to claim 1, wherein the time of heating under a pressurized atmosphere is 2 to 15 seconds.

* * * * *